US006817449B2

(12) United States Patent
Berends

(10) Patent No.: US 6,817,449 B2
(45) Date of Patent: Nov. 16, 2004

(54) VEHICLE LIFTING DEVICE

(75) Inventor: Jan Berends, Buitenpost (NL)

(73) Assignee: Stertil B.V. (NL)

( * ) Notice: Subject to any disclaimer, the term of this patent is extended or adjusted under 35 U.S.C. 154(b) by 178 days.

(21) Appl. No.: 10/293,814

(22) Filed: Nov. 12, 2002

(65) Prior Publication Data

US 2003/0121726 A1 Jul. 3, 2003

Related U.S. Application Data

(63) Continuation of application No. 09/521,755, filed on Mar. 9, 2000, now abandoned.

(30) Foreign Application Priority Data

Mar. 11, 1999 (NL) ..... 1011538

(51) Int. Cl.[7] ..... B66F 7/20

(52) U.S. Cl. ..... 187/213; 187/274; 187/275; 187/215; 91/171

(58) Field of Search ..... 187/203, 204, 187/209, 210, 213, 215, 253, 272, 273, 274, 275; 254/89 H; 91/171

(56) References Cited

U.S. PATENT DOCUMENTS 4,771,221 A * 9/1988 Finkbeiner ..... 254/89 H
5,065,844 A * 11/1991 Hon ..... 187/275
6,026,934 A * 2/2000 Deurloo ..... 187/274

FOREIGN PATENT DOCUMENTS

EP 566203 A1 * 10/1993 ..... B66F/7/20
WO WO 9830488 A1 * 7/1998 ..... B66F/3/46

* cited by examiner

*Primary Examiner*—Eileen D. Lillis
*Assistant Examiner*—Thuy V. Tran
(74) *Attorney, Agent, or Firm*—Mark Zovoko

(57) ABSTRACT

Vehicle lifting device comprising a number of columns, guides on each column for guiding a carriage for substantially vertical displacement along the column, which carriage bears vehicle supports. Lifting supports engage on the columns and the carriage. The lifting supports are connected to a motor, and a synchronization system for causing the carriages of all columns to run synchronously. The lifting supports of each column are provided with their own motor.

11 Claims, 1 Drawing Sheet

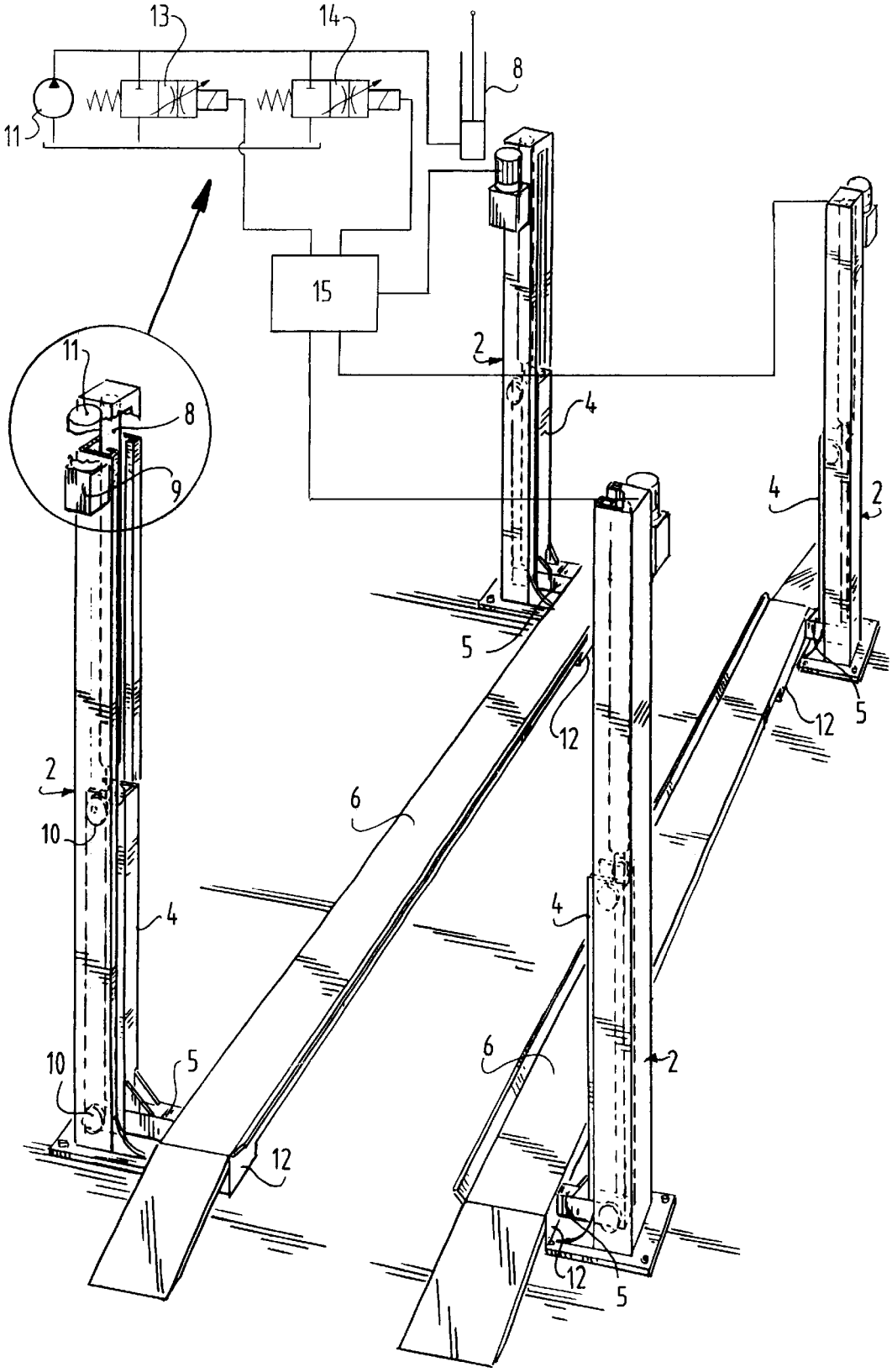
13
14
8
11
15
11
8
9
2
4
4
2
5
12
5
12
2
10
6
4
4
10
5
6
2
12
12
5

VEHICLE LIFTING DEVICE

CROSS REFERENCE TO OTHER APPLICATIONS

This application is a continuation of U.S. Ser. No. 09/521,755 filed Mar. 9, 2000 now abandoned.

BACKGROUND OF THE INVENTION

1. Field of the Invention

The invention relates to a vehicle lifting device comprising a number of columns along which carriages are movable by means of guide means. These carriages bear vehicle supporting means which can engage beneath a vehicle, such as for instance a car.

The carriage is connected to lifting means which further engage on the column, whereby the carriage can be moved upward relative to the column in order to move upward the vehicle supported by the vehicle supporting means. The lifting device further comprises synchronization means which ensure that all carriages of all columns run synchronously, whereby the supported vehicle can be moved up and downward in the same relative position.

2. Description of the Prior Art

Such vehicle lifts described above are generally known and occur in for instance two-column and four-column embodiments.

In a known four-column lift with two wheel tracks which are each supported by two columns, it is known to effect the synchronization of the two lifting means engaging on the same wheel track by making use of hydraulic cylinders connected in series. There is one drive motor therein which supplies the hydraulic power for the lifting means of the two columns. Hydraulic lines are therefore arranged along the wheel track which mutually connect the hydraulic cylinders of the two columns in the correct manner.

The maximum allowable load bearing capacity of such a lift is determined by the heaviest vehicle with a short wheel base relative to the wheel track length which can still be safely lifted when it is arranged in a most unfavorable position, i.e. with the most heavily loaded vehicle axle as far as possible to the end of a wheel track. Due to the series connection of the hydraulic cylinders, the columns furthest removed from the vehicle will have to supply only a small lifting power in such a most unfavorable loading situation. The lifting means of the most heavily loaded columns supply the greatest part of the lifting power.

BRIEF SUMMARY OF THE INVENTION

In the lifting device according to the invention the lifting means of each column are advantageously provided with their own motor. The connection present in the described prior art between the two co-acting columns can hereby be omitted, so that a simpler construction is achieved. A significant additional advantage is moreover achieved, i.e. that with the same dimensioning as in the prior art the maximum lifting capacity of the bridge is higher. The total lifting capacity of the bridge is equal to the sum of the maximum lifting capacity of all columns together. In the described prior art the maximum capacity of the bridge equals the sum of the load of the heavily loaded and lightly loaded columns in the described most unfavorable loading situation.

Nor in the prior art lift can a heavier vehicle be lifted when the center of gravity of the vehicle is properly positioned in the middle of the column, because no provisions are made to make the lifting capacity dependent on the load on the columns.

A very favorable further development is characterized by the columns having the same form. This enables rationalization of production. The cost price of the lift according to the invention can hereby be reduced in advantageous manner.

An electric motor coupled to a hydraulic pump supply the "lift" to the device. Because use is made of an electric motor as power source, control of the different columns can take place in suitable manner by electrical or electronic means.

For the lowering of a vehicle a pressure-compensated descent volume flow control valve is preferably connected in parallel to the hydraulic pump. The volume flow is herein substantially adjusted so as to be equal to that of the pump, so that ascent and descent of the vehicle lifting device takes place at roughly the same speed. Through the use of a pressure-compensated volume flow control valve the descending speed of the carriages of each of the columns will be practically the same irrespective of the load, so that the synchronization means have to provide little or no compensation.

The invention is applied in suitable manner in a vehicle lifting device having columns which in pairs bear two wheel tracks connected to the carriages. The advantage of increasing the maximum lifting capacity is particularly manifest in such a lift because the consequences of the difference in the load on the columns co-acting with one wheel track can be relatively serious.

The invention also has a support resting on the floor surface in a low position of the carriage. When a heavier vehicle corresponding to the higher lifting capacity is driven onto the lift, the higher load on the carriages and the columns on the drive-on side of the lift is absorbed by the support. Once the heavier vehicle has been positioned on the bridge, the load on the relevant carriages and columns is then reduced to the usual level. In this way it is thus possible to suffice with relatively lightly dimensioned columns.

Preferably the support described above is situated under the wheel track. Practically the whole of the load occurring during driving-on is transmitted directly to the floor surface, so that in this situation the carriages and columns remain practically unloaded. When the wheel tracks are adjusted to adapt to the tread width of the vehicle for lifting, the support moreover remains in each case precisely at the correct position for good transmission of the load.

In a preferred embodiment, flow control valves react to position sensors on the carriage resulting in a switching on of the volume control valve in the column having the highest position. By switching on the volume flow control valve of each of the columns wherein the carriage has the highest position, the ascending speed of the carriage in question is decreased or the descending speed increased, whereby the difference in measured heights is reduced.

In further preference, the position sensors in the carriage can deactivate the motors if a given difference in an individual carriage position occurs. This safety provision comes into operation as soon as a carriage of one of the columns rises no further, for instance due to overloading.

Also the descent volume control valves can be deactivated when a maximum allowable difference in the individual position sensors is reached. This ensures that no hazardous situation can occur, for instance when during descent of the bridge the wheel tracks or the vehicle encounter an obstacle, for instance a forgotten support.

In this preferred embodiment of the protection means, in a situation where the descent volume flow control valves are deactivated, the motors will also have already been deactivated. To nevertheless enable removal of the cause of the activation of the descent protection means, for instance the above mentioned forgotten support, an operating member is provided. The motors can be set into operation again by actuating this operating member, whereby the carriages move upward and the obstacle can be removed.

If an even greater difference occurs in the position determined by the position sensors, the control means will preferably fully disable the device.

The invention will be further elucidated in the following description of an embodiment with reference to the annexed FIGURE.

BRIEF DESCRIPTION OF THE DRAWING

The lone FIGURE shows a perspective view of the invention with a partial exploded schematic of the columns used in lifting.

DETAILED DESCRIPTION OF THE INVENTION

The FIGURE shows a vehicle lift of the four-column type without transverse connection.

Lift 1 thus comprises four columns 2, two pairs of which bear wheel tracks 6.

Each column 2 comprises a carriage 4 which is vertically displaceable therein by means of guide means which comprise inter alia wheels 10 on carriage 4 and the wheel tracks in column 2 co-acting therewith.

At the bottom the carriage 4 bears a vehicle support 5. As noted above, wheel tracks 6 are placed on vehicle supports 5 in this embodiment.

Carriages 4 and wheel tracks 6 with a vehicle placed thereon can thus be moved up and downward by means of hydraulic cylinders 8 arranged in each of the columns 2. Each hydraulic cylinder 8 engages with its top end on the column and with its bottom end on carriage 4.

Oil under pressure is fed to cylinder 8 by means of a hydraulic pump 9 which is driven by an electric motor 11.

Each column 2 is thus provided with its own drive unit, which in this embodiment consists of a hydraulic unit. The different motors 11 are controlled by synchronization means such that the carriages of all columns 2 can move synchronously upward in order to move the vehicle placed on wheel tracks 6 upward in the same relative position.

For lowering of the vehicle in the same relative position, descent volume control valves 13 are received in the hydraulic control means 15 in each of the columns, which valves allow controlled escape of oil from the lower side of the piston of hydraulic cylinders 8. Columns 2 are each provided with position-determining means with which the position of each of the carriages 4 is monitored. The above described control means 15 ensure that the operation of the device is blocked if too great a difference is detected in the vertical position of carriages 4. The control means 15 can be adjusted in suitable manner such that for instance at a determined height difference of 20 mm the correction volume flow control valves 14 are activated. If a greater difference occurs, for instance 30 mm, the motors are then deactivated and, at a difference of for instance 40 mm, the descent volume flow control valves 13 are moreover deactivated. At a height difference between 30 and 40 mm, the deactivation of the motors is disabled in this embodiment by actuating the operating member in order to raise the carriages again so that the problem can be obviated. In this situation two operating members must thus be intentionally actuated.

At an even greater difference, for instance 60 mm, the whole device will then be switched off completely. The obviously present emergency stop control can be combined herewith in suitable manner.

The columns 2 with the components mounted thereon, such as carriage 4 with vehicle support 5 and hydraulic cylinder 8 with hydraulic pump 9 and motor 11, are identical. The manufacture of the lift 1 and stocking of spare parts thereof can thus take place in extremely rational manner, whereby the cost price of the lift according to this embodiment of the invention can be low.

As the FIGURE further shows, the vehicle supporting means 5 are provided with supports 12 which in the shown low position of carriages 4 rest on the floor surface on which the columns are disposed. When a vehicle drives onto wheel tracks 6, the load is therefore transmitted directly to the floor surface, whereby the columns are only loaded to a very limited extent. The vehicle with a weight corresponding to the maximum lifting capacity of the device can in this way be driven onto wheel tracks 6 without there occurring a temporary overloading of vehicle supporting means 5, and thereby of column 2.

What is claimed is:

1. Vehicle lifting device, comprising a number of columns, a carriage at each of said columns and guide means on said columns for guiding the carriage for substantially vertical displacement along the column, which carriage bears vehicle supporting means, hydraulic lifting means engaging on the column and the carriage, wherein said hydraulic lifting means are connected to and driven by a motor via a hydraulic pump, and synchronization means for causing the carriage of each column to run synchronously, wherein the hydraulic lifting means of each column is provided with its own motor, and wherein for lowering said carriages a pressure-compensated descent volume flow control valve is connected in parallel to the hydraulic pump, the volume flow of which is adjusted to be substantially equal to that of said hydraulic pump when said hydraulic pump is lifting said carriages, whereby said carriages may be lowered at substantially the same speed independent of the load caused by the vehicle on said carriages.

2. Vehicle lifting device as claimed in claim 1, wherein said columns with the associated guide means, lifting means, and said carriages take an identical form.

3. Vehicle lifting device as claimed in claim 1, wherein said lifting means include an overload protection.

4. Vehicle lifting device as claimed in claim 1 comprising four columns which in pairs bear two wheel tracks forming vehicle support means which are connected to said carriages and which take an identical form.

5. Vehicle lifting device as claimed in claim 1, wherein said columns are disposed on a floor surface and said vehicle supporting means bear a support resting on the floor surface in a low position of said carriage.

6. Vehicle lifting device as claimed in claim 5, wherein said support resting on the floor surface is situated under said vehicle support means for the vehicle to be lifted.

7. Vehicle lifting device as claimed in claim 1, wherein said synchronization means comprise positions sensors for each of said carriages, correction volume flow control valves connectable in parallel to each of said pumps, the volume flow of said valves is adjusted to a portion of that of the associated pump, and control means connected to said position sensors and said correction volume flow control valves which in each case can switch on the correction volume flow control valve of said column in which said carriage has the highest position.

8. Vehicle lifting device as claimed in claim 7, wherein said control means are embodied such that they deactivate said motors when a maximum allowable difference in the positions determined with said position sensors is exceeded by a first determined value.

9. Vehicle lifting device as claimed in claim 8, wherein said control means are embodied such that they deactivate said descent volume flow control valves when a maximum allowable difference in the positions determined with said position sensors is exceeded by a second, larger determined value.

10. Vehicle lifting device as claimed in claim 9, wherein said control means comprise an operating member which, when actuated in the situation where said descent volume flow control valves are deactivated, disables deactivation of said motors.

11. Vehicle lifting device as claimed in claim 9, wherein said control means switch off the device completely when a maximum allowable difference in the positions of said carriages determined with said positions sensors is exceeded by a third determined value, larger than said first or second value.

* * * * *